United States Patent [19]

Sandish et al.

[11] Patent Number: 4,889,239

[45] Date of Patent: Dec. 26, 1989

[54] FOOD AND BEVERAGE CUP PACKAGE

[76] Inventors: George R. Sandish, Annapolis, Md.; Henry Wischusen, III, Lilburn, Ga.

[21] Appl. No.: 526,319

[22] Filed: Aug. 25, 1983

[51] Int. Cl.[4] ..... B65D 5/54

[52] U.S. Cl. ..... 206/611; 206/562; 206/620; 206/628; 229/19; 229/117.01; 229/904

[58] Field of Search ..... 206/216, 217, 218, 525, 206/558, 628, 45.14, 45.19, 45.31, 562, 620, 611; 229/9, 10, 11, 19, 20, 41 B; 53/452, 462

[56] References Cited

U.S. PATENT DOCUMENTS

| | | | |
|---|---|---|---|
| 1,925,102 | 9/1933 | Levkoff | 206/44 |
| 2,238,545 | 4/1941 | Whiley | 206/427 |
| 2,403,840 | 7/1946 | Ashurst | 6/9 |
| 2,604,980 | 7/1952 | Reid | 206/121 |
| 2,663,489 | 12/1953 | Paige . | |
| 2,711,819 | 6/1955 | Vander Lugt, Jr. | 206/45.14 |
| 2,732,983 | 1/1956 | Siddall . | |
| 2,875,940 | 3/1959 | Dunn . | |
| 2,904,170 | 9/1959 | Hennessey et al. | 206/525 |
| 3,005,584 | 10/1961 | Coe | 229/28 R |
| 3,074,615 | 1/1963 | Johnson . | |
| 3,195,719 | 7/1965 | Giesler | 206/216 |
| 3,207,411 | 9/1965 | Farquhar | 206/628 |
| 3,208,583 | 9/1965 | Kamps | 206/44 |
| 3,215,332 | 11/1965 | Bess . | |
| 3,281,054 | 10/1966 | Buttery . | |
| 3,286,830 | 11/1966 | Robb, Jr. | 206/628 |
| 3,288,344 | 12/1966 | Woollen . | |
| 3,322,329 | 5/1967 | Castaneda et al. | 206/629 |
| 3,323,706 | 6/1967 | Gereke . | |
| 3,326,445 | 6/1967 | Goings . | |
| 3,348,672 | 10/1967 | Brown . | |
| 3,349,985 | 10/1967 | Salway | 206/557 |
| 3,365,114 | 1/1968 | Macchi . | |
| 3,376,974 | 4/1968 | Hilliard | 206/217 |
| 3,397,776 | 8/1968 | Weiss . | |
| 3,398,856 | 8/1968 | Graser . | |
| 3,411,696 | 11/1968 | Ayer et al. | 229/40 |
| 3,512,697 | 5/1970 | Robinson . | |
| 3,522,907 | 8/1970 | Utterback . | |
| 3,580,483 | 5/1971 | Young | 206/612 |
| 3,587,837 | 6/1971 | Smith et al. | 206/45.14 |
| 3,604,560 | 9/1971 | Farquhar | 206/491 |
| 3,618,848 | 11/1971 | Pawlowski et al. | 206/491 |
| 3,637,130 | 1/1972 | Farquhar . | |
| 3,659,707 | 5/1972 | Nilsson et al. . | |
| 3,669,251 | 6/1972 | Phillips, Jr. | 206/44 |
| 3,679,122 | 7/1972 | Neff | 229/40 |
| 3,705,681 | 12/1972 | Rossi et al. | 229/40 |
| 3,722,781 | 3/1973 | Page et al. . | |
| 3,811,560 | 5/1974 | Schilling et al. | 206/541 |
| 3,829,006 | 8/1974 | Spiegel | 206/608 |

(List continued on next page.)

FOREIGN PATENT DOCUMENTS

| | | | |
|---|---|---|---|
| 272792 | 4/1963 | Australia . | |
| 268988 | 5/1968 | Austria . | |
| 687951 | 6/1964 | Canada . | |
| 980174 | 6/1964 | France . | |
| 1173963 | 12/1969 | United Kingdom | 206/45.14 |
| 1222375 | 2/1971 | United Kingdom | 229/10 |
| 1380921 | 1/1975 | United Kingdom | 229/9 |

*Primary Examiner*—Stephen Marcus
*Attorney, Agent, or Firm*—Thomas R. Boston; W. Dexter Brooks

[57] ABSTRACT

A method and package for holding food and a beverage cup wherein the package includes a paperboard sleeve defining an elongated enclosure of rectangular cross-section extending therethrough and including a rectangular opening at one end thereof into said enclosure. The sleeve includes a tub holding first portion and a beverage cup holding second portion. An open top food tub is slid into the enclosure through the opening and stop means are provided for holding the tub in the first portion of the sleeve. The top panel of the sleeve includes a tear away panel overlying the tub for providing access to the food in the tub. The tub rigidifies the sleeve, and prevents fluids in the food from leaking out of the package. The sleeve provides a lid for the tub, protects the food and keeps it warm. The top panel of the sleeve includes a cup receiving aperture in the second portion thereof and the stop means prevents the tub from interfering with the cup.

21 Claims, 3 Drawing Sheets

U.S. PATENT DOCUMENTS 3,904,029 9/1975 Koltz ..... 206/45.34
3,907,195 9/1975 Struble ..... 229/41 B
3,954,220 5/1976 Foster .
3,977,518 8/1976 Arneson ..... 206/141
4,000,811 1/1977 Hardison et al. ..... 206/44 R
4,013,748 3/1977 Goltsos ..... 229/9
4,069,917 1/1978 Stollberg et al. ..... 206/423
4,113,100 9/1978 Soja et al. ..... 206/602
4,130,237 12/1978 Struble ..... 229/40
4,180,165 12/1979 Kuchenbecker ..... 206/461
4,221,320 9/1980 Faller .
4,326,356 4/1982 Mason ..... 46/154
4,360,107 11/1982 Roccaforte ..... 206/626

FOOD AND BEVERAGE CUP PACKAGE

BACKGROUND OF THE INVENTION

1. Field of the Invention

This invention relates to trays, containers, packages and the like for holding both food and a beverage cup, such as disposable trays for holding popcorn (or other "fast food" items) and a soft drink at ball games, theaters, etc.

2. Description of the Prior Art

Many attempts have been made in the food and concessions industry to provide customers with convenient containers in which to carry food and drink from the point of sale to the point of use. In many cases, the food is wrapped, the soft drink cups are capped with plastic snap-on closures, and both are placed in paper sacks. Since paper sacks have no rigidity, this practice often leads to the drink leaking onto the customer's clothes and onto the food, and also leads to the food in open ended containers, such as french fries or popcorn, falling to the bottom of the sack. In addition, the cold drink is often in contact with the hot food, thus cooling the food. When the food is not placed in a paper sack, it is often open to the cooling effect of the air and is also exposed and unprotected.

Paperboard trays have been developed to attempt to provide a better means for holding and transporting the food and drink. In one well-known tray, four receptacles for retaining drink cups are provided, two at each end of the tray, separated by an open area into which the food can be placed. Such trays leave exposed food such as popcorn or french fries unprotected and are very unstable and require the use of both hands to carry them.

U.S. Pat. Nos. 3,640,380, 2,732,983 and 3,376,974 show devices for carrying, food and drinks; U.S. Pat. Nos. 4,221,320 and 2,711,819 show food containers slidably received in a sleeve; U.S. Pat. Nos. 3,288,344 and 3,323,706 show combined food and beverage containers; U.S. Pat. No. 3,195,719 shows a tray for a box and a bottle; U.S. Pat. No. 3,349,985 shows a food tray and a shell sealed to the tray; U.S. Pat. Nos. 2,238,545, 3,722,781 and 3,005,584 show carrying trays; U.S. Pat. Nos. 3,604,560, 3,907,195 and 3,618,848 show paperboard packages for holding food containers, and U.S. Pat. No. 2,403,840 shows a shipping package.

BRIEF SUMMARY OF THE INVENTION

A method and a package for holding a food and a drink or other liquid container (hereinafter referred to as a beverage cup) comprising a paperboard sleeve surrounding an elongated enclosure of rectangular cross-section extending therethrough and including a rectangular opening at one end thereof into said enclosure. The sleeve includes a food tub holding first portion and a beverage cup holding second portion. A food tub is slidably received into the enclosure in the first portion of the sleeve and a beverage cup is received in a cup receiving aperture in the top panel of the sleeve in the second portion of the sleeve. The tub contacts the inside surfaces of all of the sleeve panels so as to rigidify the sleeve. The top panel of the sleeve serves as a lid for the tub, to heat, insulate and to protect the food, and to prevent it from falling out of the tub. The package includes stop means for holding said tub in said first portion of said sleeve and spaced away from the beverage cup. The sleeve also includes a tear away panel in the top panel overlying the tub for providing access to the food in the tub. The cup is held in place by a combination of the bottom wall of the sleeve and a plurality of tabs in the cup receiving aperture, and the height of the sleeve provides stability to the cup to prevent the cup from tipping over or falling out of the sleeve.

It is an object of this invention to provide an improved method and package for holding a food and a beverage cup.

It is another object to provide a package that will prevent fluid from the food from leaking onto the customer's clothes.

It is a further object to provide a package that holds a food and beverage cup in a relatively rigid, stable and protected condition and that can be carried by one hand.

It is a still further object to provide a package that is easy to set up and assemble and pack with a food and a beverage cup.

BRIEF DESCRIPTION OF THE DRAWINGS

The present invention will be more fully understood from the detailed description below when read in connection with the accompanying drawings which are given by way of illustration only and thus are not limitative of the present invention, and wherein.

DETAILED DESCRIPTION OF THE INVENTION

Figures 1, 2:
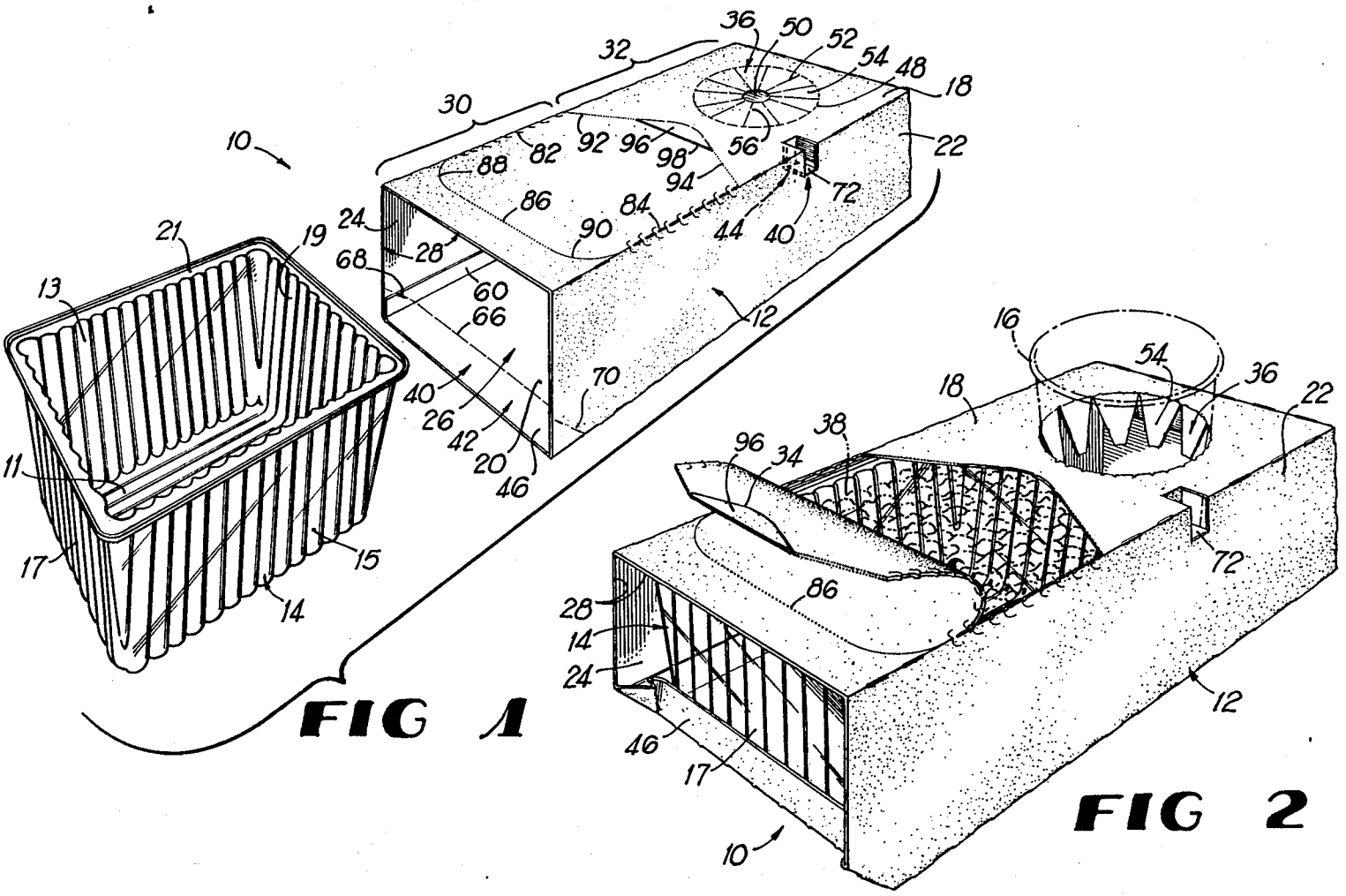
FIG. 1 is an exploded perspective view of the sleeve and tub of the present invention.
FIG. 2 is a perspective view of the package of the present invention showing the sleeve, the tub and the beverage cup.

With reference now to the drawings, FIGS. 1, 2, 6 and 7 show a food and drink package 10 according to the preferred embodiment of the present invention.

The package 10 comprises a paperboard sleeve 12, a food tub 14, and a beverage cup 16. The sleeve 12 includes a top panel 18, a bottom panel 20, and a pair of side panels 22 and 24. The sleeve 12 surrounds an elongated enclosure 26 having a rectangular cross-section and includes a rectangular opening 28 at one end thereof. The sleeve 12 includes a tub holding first portion 30 and a cup holding section portion 32. The top panel 18 has a tear away panel 34 overlying the tub 14 for providing access to the food (such as popcorn 38 in FIG. 2) in the tub 14 and a cup receiving aperture 36 located in the second portion 32 for receiving the cup 16. The package 10 also includes stop means 40 for holding the tub 14 in place in the first portion 30 of the sleeve 12. The sleeve 12 will be described in more detail below with reference to FIGS. 3–5.

In use, the sleeve 12, which is normally stored in a flat condition (see FIG. 3, described below) is moved to its erect condition, the food such as popcorn is placed in the tub 14 and the tub is inserted through the opening 28 into the enclosure 26. The stop means 40 are then moved to their locking position to maintain and hold the tub 14 in the first portion 30 of the sleeve 12. A beverage is then dispensed into the cup 16 and the cup is inserted through the aperture 36 and down into contact with the bottom panel 20, such that the cup is held in a very stable position. The package 10 can now be easily carried away by a customer using only one hand and without even having to take care to hold it exactly level. The tear away panel 34 is then torn and folded back to provide access to the food 38 in the tub 14. If the food is not all eaten at one time, the panel 34 can be replaced to continue to serve as a lid.

The tub 14 preferably includes a bottom wall 11, a pair of side walls 13 and 15, a pair of end walls 17 and 19 and a flange 21 around its upper edge and is adapted to hold any type of food and is preferably made of plastic so that any oil, grease, or other fluid associated with the food therein can not leak out of the tub and through the sleeve and onto the customers' clothes or onto furniture. Other fluid impervious materials can be used, of course, and when no fluids are associated with the food, the tub need not be made of fluid impervious material. It is also preferred that the tub be made imperforate, so as, for example, to help keep warm food warm. The tub preferably has a width and a height such that it can be inserted into the enclosure 26 through the opening 28 and when properly positioned in the first portion 30 is in contact with the inside surfaces of all four sleeve panels and is of such rigidity itself as to serve to rigidify the sleeve 12. The sleeve is foldable or collapsible, however, the combination of the sleeve 12 and the tub 14 is an erect and relatively rigid structure that can be easily and simply carried by one hand without the possibility of spilling any of the popcorn 38 and without even having to hold the package 10 level. The tub 14 preferably has a height approximately equal to or even slightly greater than the height of the enclosure 26 so that the top panel 18 serves as a lid in contact with the tub to close the open top of the tub, prevent food from spilling out, help keep warm food warm, and help to rigidify the sleeve. The tub 14 also preferably has at least a portion thereof that has a width equal to or even slightly greater than that of the enclosure 26 to help rigidify the package 10.

The tear away panel 34 can be completely torn off from the top panel 18 or one of the connections can be left to serve as a hinge connection to the sleeve so that the panel 34 can be replaced to continue to serve as a lid for the tub 14.

The stop means 40 is preferably a portion of the sleeve itself although it can alternatively be a separate element, or a part of the tub or a combination of the tub and sleeve. The stop means 40 is preferably a pair of stop means, one for contacting each end of the tub. The preferred stop means 40 includes a first stop means 42 adjacent the opening 28 for contacting one end of the tub and preventing movement of the tub out the opening 28, and a second stop means 44 for contacting the other end of the tub for preventing the tub from moving into the second portion 32 of the sleeve. The tub 14 preferably has a length such that it occupies substantially the entire first portion 30 of the sleeve 12. The stop means will be described below in more detail along with the detailed description of the sleeve.

The cup receiving aperture 36 is centrally located in the top panel 18 in the middle of the second portion 32. Of course, more than one such aperture can be used by enlarging the second portion 32. The cup receiving aperture 36 includes a circular jump cut score 48 having a diameter selected to be slightly larger than the appropriate diameter of the cup 16 or can to be received therein and which rests upon the bottom panel 20. A concentric opening 50 is cut out within the circular score 48, and the opening 50 is joined to the score 48 by plurality of radial break-away cuts 52 thus providing a plurality of tabs 54. Each break-away cut 52 includes at least one joining connection 56 along its length. When a cup 16 is inserted downwardly through the aperture 36, the joining connections 56 give way easily, allowing the tabs 54 to fold down into the enclosure 26 and to surround and support the cup 16 along the full length of the tabs 54. The height of the sleeve 12 is sufficient such that when the cup 16 is received in the aperture 36 and is resting on the bottom panel 20, the cup is held in a very stable condition such that it can not fall over or fall out of the sleeve. If the cup 16 has a tight lid, the package 10 can be tilted a substantial amount with no effect on the food or drink.

Figure 3:
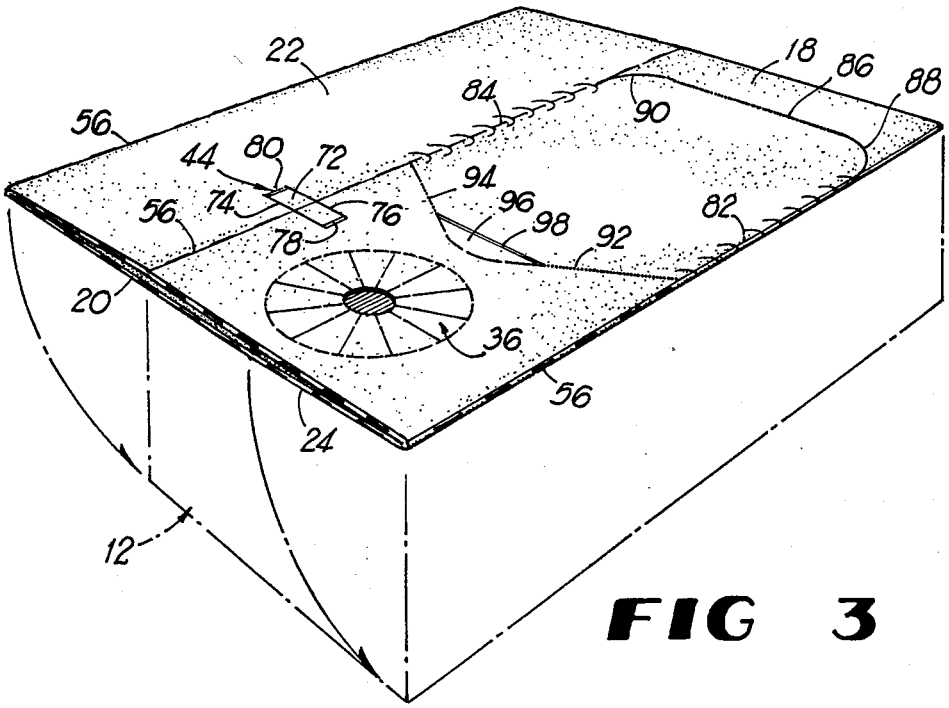
FIGS. 3–5 are perspective views of the sleeve showing it collapsed in FIG. 3, partly erect in FIG. 4 and fully erect in FIG. 5.
Figure 4:
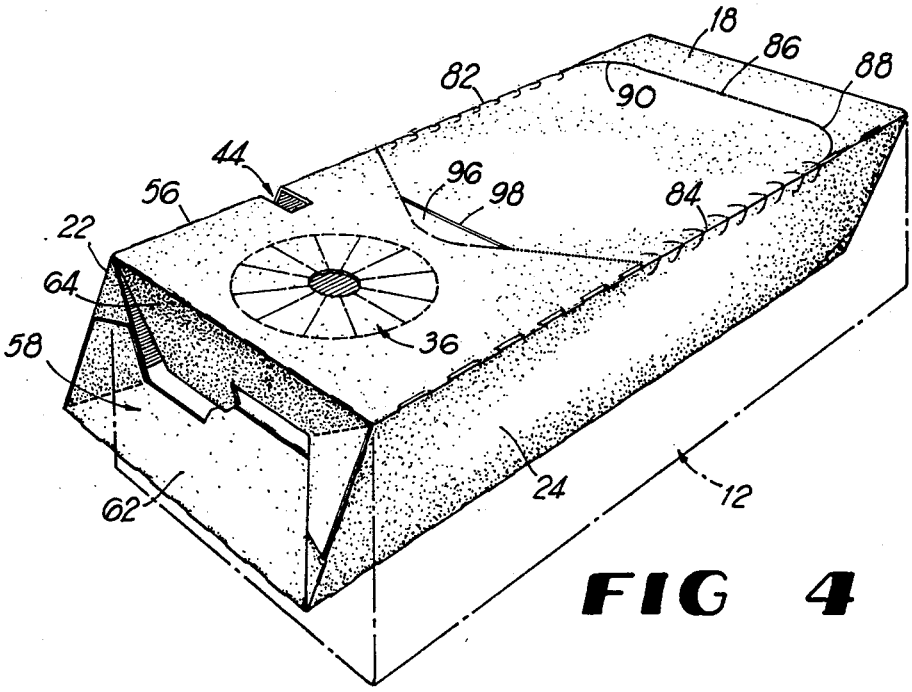
Figure 5:
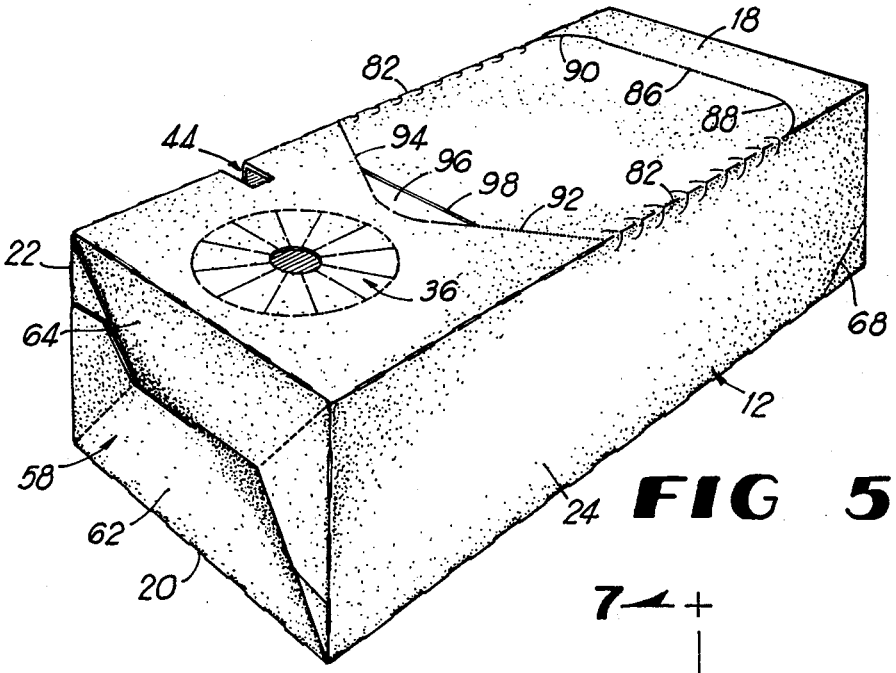

The sleeve 12 will now be described in more detail with reference primarily to FIGS. 3–5. FIG. 3 shows the sleeve in its collapsed or folded condition, FIG. 4 shows it partly erect, and FIG. 5 shows it fully erect. FIG. 5 also shows the other end of the sleeve from that shown in FIGS. 1 and 2 and shows a closed end wall 58. This end can be open or closed but is preferably closed. The sleeve 12 is preferably assembled from a paperboard blank appropriately cut and scored. FIG. 1 shows a glue flap 60 used to form the blank into a sleeve. The top, bottom and side panels 18, 20, 22 and 24 respectively are foldably interconnected by four parallel jump cut scores. The end wall 58 forms a conventional "automatic bottom" closure, such that when the sleeve is moved to its erect condition in FIG. 5 the flaps 62 and 64 thereof interlock to provide some rigidity to at least the closed end portion of the sleeve.

Figure 6:
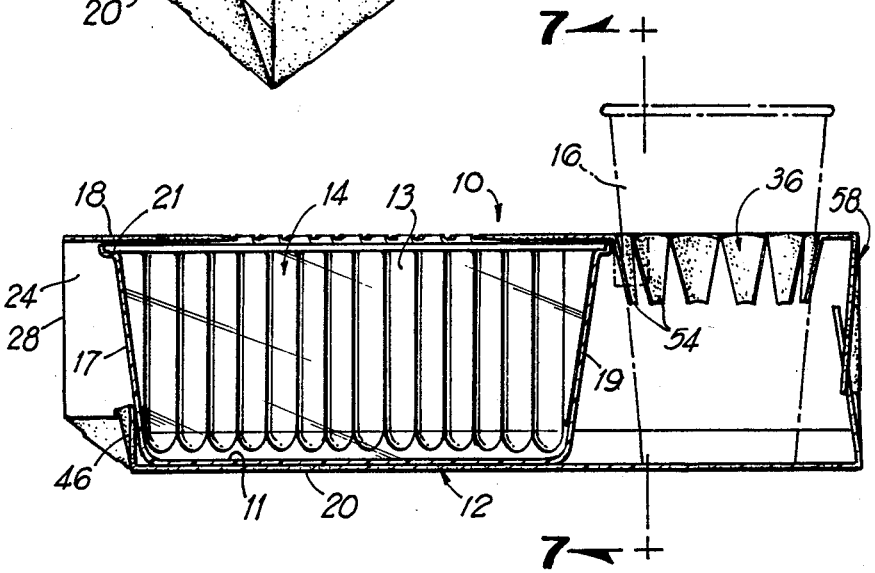
FIG. 6 is a partly cross-sectional side view through the package of the present invention.
Figure 7:
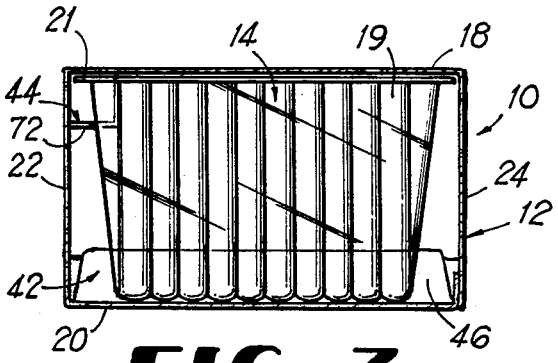
FIG. 7 is a partly cross-sectional end view through the package of the present invention taken along line 7—7 of FIG. 6.

The sleeve 12 also includes the first and second stop means 42 and 44, respectively. The first stop means includes a retaining flap 46 defined by the bottom panel 20 and adjacent to the open end 28 of the sleeve 12. A transverse jump cut score 66(FIG. 1) extends across the bottom panel 20 parallel to the exposed edge and spaced inwardly a short distance from the edge. From each end of the score 66 where the score 66 meets one of the longitudinal scores between a side panel and the bottom panel, diagonal scores 68 and 70, respectively, extend across a corner of the respective side panel to the exposed edge 33. The retaining flap 46 thus has two positions, an open position, as shown in FIG. 1 and a closed or locking position, as shown in FIGS. 2, 6 and 7.

The second stop means 44 includes a stop panel 72 defined by the top panel 18 and the side panel 24. Parallel transverse cuts 74 and 76 span the score between the panels 18 and 22 and are connected at their ends by a score 78 in the top panel 18, and a score 80 in the side panel 24. After the sleeve 12 has been erected, the stop panel 72 can be popped into the sleeve 12, as shown in FIGS. 1, 2, 4, 5 and 7. In such configuration, it will prevent the tub 14 from sliding too far into the sleeve 12. The stop panel 72 preferably maintains an air space between the cup 16 and the tub 14. If either the beverage or the food is hot or cold, this air space will help to prevent heat transfer.

Regarding the tear away panel 34, this panel is defined in the top panel 18. The tear-away panel 34 is defined by a pair of "zipper rule" scores 82 and 84 extending along the two longitudinal scores at each side of the top panel. Adjacent to the open end of the sleeve 12, the zipper scores 82 and 84 are connected by a 1/32 inch perforation 86 extending transversely across the top panel 18, and by a pair of curved cut corners 88 and 90 which connect the zipper scores 82 and 84 to the perforation 86. At the opposite end of the tear away panel, diagonal perforations 92 and 94 extend from the zipper scores toward the center of the top panel 18 where they meet at a break away tab 96. The tab 96 is defined by a curved cut in the top panel 18, the ends of which are connected by a transverse score 98. The tab 96 can be snapped into the box about the score 98 so that the tear away panel 34 can be grasped for removal. The cut corners 88 and 90, and the cut forming the break away tab 96 can include small joining connections at widely spaced intervals. The joining connections are very easily broken when desired, but provide stability before use of the tray. When the user desires to eat the food, a finger is placed upon the break away tab 96, and the tab is folded into the sleeve 12 and against the lower side of the tear away panel 34. This allows the user to grasp the panel and to pull upwardly. The perforations 92 and 94 will give way, and then the panel 34 is torn away along the zipper scores 82 and 84. Finally, a transverse pull on the panel 34 can tear the panel 34 away along the perforation 86, exposing the food in the tub 14.

While the present invention has been with reference to the preferred embodiment thereof, it is noted that the invention is not limited thereto. For example, the tub need not be plastic, the stop means need not be a pair thereof at the ends of the tub but can be just one that interacts with the tub; also the stop means do not have to contact the tub at its ends. The stop means do not have to be foldable panels of the sleeve but could be part of the tub interacting with an opening in the sleeve, for example. The tear away panel can be torn away completely or left with a hinge connection as at 86 for reapplying over the tub, and/or the tub can have its own lid. More than one separate tub can be used if desired. The cup itself can be used as one of the stops if desired. The panel 46 can be replaced by a panel of the type used in the second stop means 44. Different shapes of tubs can be used and the aperture 36 can be located at other positions if desired, for example, if the tub is L-shaped and has a length equal to that of the sleeve, the aperture 36 would be offset. The paperboard of the sleeve can be relatively stiff or even relatively flexible since the combination therewith of a relatively rigid tub would still result in a relatively rigid package. The end wall 58 can be a stop means against which the tub can be placed and the cup 16 can be a second stop means. While it is not essential that the tub contact all four sleeve panels, it is preferred that it do so to better rigidify the sleeve.

What is claimed is:

1. A disposable package for holding food and a beverage cup comprising:

(a) a paperboard sleeve comprising a top panel, a bottom panel and a pair of side panels defining an elongated enclosure of rectangular cross-section extending therethrough between a pair of opposite ends of said sleeve, at least one of said sleeve ends defining a rectangular opening into said enclosure, said sleeve including a tub holding first portion and a separate cup holding second portion;

(b) a tub, adapted to hold a quantity of food, positioned in said enclosure in said first portion of said sleeve, said tub comprising a bottom wall, a pair of sidewalls and a pair of end walls, the height and width of said tub being such that said tub can be slid into said enclosure through said rectangular opening and also being such that said tub contacts the inside surfaces of each of said top, bottom and side panels of said sleeve for adding rigidity to said sleeve;

(c) stop means for maintaining said tub in said first portion of said sleeve;

(d) cup receiving aperture means located in said top panel of said sleeve in said second portion of said sleeve for cooperating with said bottom panel of said sleeve for holding a beverage cup, said stop means preventing said tub from moving underneath said cup receiving aperture means for preventing said tub from interfering with the insertion of a cup into said cup receiving aperture means; and (e) tear away panel means in said top panel of said sleeve confined to first portion thereof and overlying said tub for providing access to said tub but not overlying said cup receiving aperture means.

2. The package as recited in claim 1 including a beverage cup received in said cup receiving aperture means and supported jointly by said bottom panel and said cup receiving aperture means.

3. The package as recited in claim 2 wherein said sleeve has a height greater than fifty percent of the height of said cup, whereby said cup is held by said sleeve in a stable condition.

4. The package as recited in claim 2 wherein said cup is maintained by said stop means out of contact with said tub.

5. The package as recited in claim 1 wherein said cup receiving aperture means consists of only a single aperture means centrally located in said top panel in said second portion of said sleeve.

6. The package as recited in claim 1 wherein said tub is plastic.

7. The package as recited in claim 1 wherein said tub is fluid impervious.

8. The package as recited in claim 1 wherein said stop means comprises a pair of first and second stop means.

9. The package as recited in claim 1 wherein said stop means comprises a pair of first and second stop means for contacting opposite ends of said tub for preventing the sliding movement of said tub in said enclosure in either direction past either one of said pair of stop means.

10. The package as recited in claim 9 wherein each of said pair of stop means comprises foldable panel means of said sleeve for folding from a first position in which each of said foldable panel means are coextensive with said sleeve panels to a second position in which said panel means extend into said enclosure a sufficient distance to provide a stop for preventing movement of said tub past said stop.

11. The package as recited in claim 1 wherein said sleeve includes one end wall for closing one end of said enclosure and for rigidifying said sleeve.

12. The package as recited in claim 1 wherein said sleeve can be erected from a flat collapsed condition.

13. The package as recited in claim 1 wherein said tub is an open top tub.

14. The package as recited in claim 1 wherein said tub walls are all imperforate.

15. The package as recited in claim 1 wherein said tear away panel means includes a hingeable connection to said sleeve, whereby said tear away panel means can be lifted up to provide access to said tub and then returned in place over said tub.

16. A package for holding food and a beverage cup comprising:

(a) a paperboard sleeve comprising a top panel, a bottom panel and a pair of side panels defining an elongated enclosure of rectangular cross-section extending therethrough between a pair of opposite ends of said sleeve, one of said sleeve ends defining a rectangular opening into said enclosure, said sleeve including a tub holding first portion and a separate cup holding second portion, the other one of said sleeve ends including an end wall for closing said other end of said enclosure and for rigidifying said sleeve, said sleeve being adapted to be erected from a flat collapsed condition to an erect condition;

(b) an open top plastic tub positioned in said enclosure in said first portion of said sleeve, said tub comprising a bottom wall, a pair of side walls and a pair of end walls, all of said tub walls being imperforate the height and width of said tub being such that said tub can be slid into said enclosure through said rectangular opening and also being such that said tub contacts the inside surfaces of each of said top, bottom and side panels of said sleeve for adding rigidity to said sleeve;

(c) stop means for maintaining said tub in said first portion of said sleeve, said stop means comprising a pair of first and second separate stop means for contacting opposite ends of said tub for preventing the sliding movement of said tub in said enclosure in either direction past either one of said pair of said stop means, each of said stop means comprising a foldable panel means of said sleeve for folding from a first position in which said panel means are coextensive with said sleeve panels to a second position in which said panel means extend into said enclosure a sufficient distance to provide a stop for preventing movement of said tub past said stop;

(d) cup receiving aperture means located in said top panel of said sleeve in said second portion of said sleeve for cooperating with said bottom panel of said sleeve for holding a beverage cup, said stop means preventing said tub from moving underneath said cup receiving aperture means for preventing said tub from interfering with the insertion of a beverage cup into said cup receiving aperture means, a beverage cup received in said cup receiving aperture means and supported jointly by said bottom panel of said sleeve and said cup receiving aperture means, said sleeve having a height greater than 50% of the height of said cup whereby said cup is held by said sleeve in a stable condition; and (e) tear away panel means in said top panel of said sleeve confined to said first portion thereof and overlying said tub for providing access to said tub but not overlying said cup receiving aperture means.

17. A method for holding food and a beverage cup comprising the steps of:

(a) providing a paperboard sleeve comprising a top panel, a bottom panel, and a pair of side panels defining an elongated enclosure of rectangular cross-section extending therethrough between a pair of opposite ends of said sleeve, (b) providing a rectangular opening into said enclosure through at least one of said sleeve ends;

(c) inserting an open top food tub into said enclosure through said rectangular opening such that said tub contacts the inside surfaces of each said top, bottom and side panels of said sleeve for adding rigidity to such sleeve;

(d) maintaining said tub in a tub holding first portion of said sleeve;

(e) inserting a beverage cup having a height less than twice the height of said sleeve into a cup receiving aperture located in said top panel of said sleeve in a cup holding second portion of said sleeve, and moving said cup down into contact with said bottom panel of said sleeve for maintaining said cup in a stable condition; and (f) providing access to said tub by removing a tear away panel in said top panel of said sleeve overlying said tub.

18. The method as recited in claim 17 wherein said maintaining step comprises folding panel means of said sleeve inwardly into said enclosure a sufficient distance to contact said tub and preventing said tub from moving past said panel means.

19. The method as recited in claim 18 wherein said folding step comprises folding a pair of spaced-apart panel means into said enclosure, one adjacent each end of said tub.

20. The method as recited in claim 17 including the step of erecting said sleeve from a flat collapsed condition.

21. The method as recited in claim 17 including providing said sleeve with an end wall at the other end of said sleeve for adding rigidity thereto.

* * * * *

UNITED STATES PATENT AND TRADEMARK OFFICE

CERTIFICATE OF CORRECTION

PATENT NO. : 4,889,239

DATED : Dec. 26, 1989

INVENTOR(S) : Sandish et al.

It is certified that error appears in the above-identified patent and that said Letters Patent is hereby corrected as shown below:

Col. 6, Claim 1, line 19, after "to" insert --said--.

Signed and Sealed this

Fifth Day of May, 1992

*Attest:*

DOUGLAS B. COMER

*Attesting Officer*

*Acting Commissioner of Patents and Trademarks*